US009551342B2

(12) United States Patent
Huang et al.

(10) Patent No.: US 9,551,342 B2
(45) **Date of Patent: *Jan. 24, 2017**

(54) SCROLL COMPRESSOR WITH A SHUNT PULSATION TRAP

(71) Applicants: Paul Xiubao Huang, Fayetteville, GA (US); Sean William Yonkers, Peachtree City, GA (US)

(72) Inventors: Paul Xiubao Huang, Fayetteville, GA (US); Sean William Yonkers, Peachtree City, GA (US)

( * ) Notice: Subject to any disclaimer, the term of this patent is extended or adjusted under 35 U.S.C. 154(b) by 139 days.

This patent is subject to a terminal disclaimer.

(21) Appl. No.: 14/285,678

(22) Filed: May 23, 2014

(65) Prior Publication Data

US 2015/0337841 A1 Nov. 26, 2015

(51) Int. Cl.

| | |
|---|---|
| ***F04C 29/06*** | (2006.01) |
| ***F04C 29/12*** | (2006.01) |
| ***F04C 18/02*** | (2006.01) |
| ***F04C 29/00*** | (2006.01) |

(52) U.S. Cl.

CPC ..... *F04C 29/065* (2013.01); *F04C 18/0215* (2013.01); *F04C 29/0035* (2013.01); *F04C 29/06* (2013.01); *F04C 29/061* (2013.01); *F04C 29/063* (2013.01); *F04C 29/066* (2013.01); *F04C 29/068* (2013.01); *F04C 29/12* (2013.01); *F04C 29/122* (2013.01); *F04C 29/124* (2013.01); *F04C 29/126* (2013.01); *F04C 29/128* (2013.01)

(58) Field of Classification Search

CPC ..... F04C 29/06–29/128

See application file for complete search history.

(56) References Cited

U.S. PATENT DOCUMENTS

| | | | |
|---|---|---|---|
| 2,489,887 | A | 11/1949 | Houghton |
| 4,215,977 | A | 8/1980 | Weatherston |
| 4,558,566 | A | 12/1985 | Shirakura |
| 4,984,974 | A | 1/1991 | Naya et al. |
| 5,051,077 | A | 9/1991 | Yanagisawa et al. |

(Continued)

FOREIGN PATENT DOCUMENTS

| | | |
|---|---|---|
| JP | 60252117 | 12/1985 |
| JP | 01032085 | 2/1989 |

(Continued)

*Primary Examiner* — Nicholas J Weiss
*Assistant Examiner* — Wesley Harris
(74) *Attorney, Agent, or Firm* — Gardner Groff Greenwald & Villanueva, P.C.

(57) ABSTRACT

A shunt pulsation trap for a scroll compressor reduces gas pulsations, NVH and improves off-design efficiency. Generally, a scroll compressor with the shunt pulsation trap has a pair of orbiting and stationary scrolls for forming a compression chamber that moves gas pockets from a suction port to a discharge port with internal compression. The shunt pulsation trap is configured to trap and attenuate as pulsations before the discharge port and comprises a pulsation trap chamber adjacent to the compression chamber, therein housed various gas pulsation dampening means or gas pulsation containment means, at least one trap inlet port branching off from the compression chamber into the pulsation trap chamber and a trap outlet port communicating with the compressor discharge chamber after the discharge port.

20 Claims, 11 Drawing Sheets

(56) References Cited

U.S. PATENT DOCUMENTS

| | | | | |
|---|---|---|---|---|
| 5,218,817 | A | 6/1993 | Urata | |
| 5,370,512 | A | 12/1994 | Fujitani et al. | |
| 5,975,035 | A | 11/1999 | McWhorter | |
| 6,331,103 | B1 | 12/2001 | Teraoka | |
| 6,874,486 | B2 | 4/2005 | Prior et al. | |
| 8,172,039 | B2 | 5/2012 | Park et al. | |
| 2002/0033302 | A1 | 3/2002 | Kaneko et al. | |
| 2006/0243520 | A1 | 11/2006 | Hertenstein et al. | |
| 2008/0168961 | A1 | 7/2008 | Prior et al. | |
| 2010/0269797 | A1 | 10/2010 | Prior | |
| 2011/0300014 | A1* | 12/2011 | Huang | F04C 18/086 418/206.5 |
| 2012/0020824 | A1 | 1/2012 | Huang et al. | |
| 2012/0171069 | A1 | 7/2012 | Huang et al. | |
| 2012/0237378 | A1 | 9/2012 | Huang et al. | |
| 2012/0297818 | A1* | 11/2012 | Toyama | F04B 39/023 62/470 |
| 2013/0247849 | A1 | 9/2013 | Huang et al. | |

FOREIGN PATENT DOCUMENTS

| | | |
|---|---|---|
| JP | 03124986 | 5/1991 |
| JP | 07332273 | 12/1995 |

* cited by examiner

SCROLL COMPRESSOR WITH A SHUNT PULSATION TRAP

BACKGROUND OF THE INVENTION

1. Field of the Invention

The present invention relates generally to the field of scroll compressors, and more particularly relates to a shunt pulsation trap for reducing gas pulsations and induced vibration, noise and harshness (NVH), and improving compressor off-design efficiency.

2. Description of the Prior Art

A scroll compressor (also called scroll pump and scroll vacuum pump) is a device for compressing air, gas or refrigerant. It is used in air conditioning and refrigeration, as an automobile supercharger and as a vacuum pump. A scroll compressor operating in reverse is known as a scroll expander, and can be used to generate mechanical work from the expansion of a fluid, compressed air or gas. Many residential central heat pump and air conditioning systems and a few automotive air conditioning systems employ a scroll compressor instead of the more traditional rotary, reciprocating, and wobble-plate compressors.

A scroll compressor consists of a stationary scroll, which has a discharge port at the center, and an orbiting scroll that revolves around the stationary scroll without rotating around its own axis. The gas is first sucked into the compression pockets from the peripheral side of the scroll. Then the gas is compressed as the volume of the trapped pockets becomes decreased, and is released near the center of the scrolls to a discharge port to finish the cycle. It is essentially a positive displacement mechanism but using an orbiting scroll instead of a reciprocating piston so that displacement motion can be much faster without experiencing any shaking forces. The result is a more continuous and smoother stream of flow with a more compact size and replacing the traditional reciprocating or rolling piston types.

It has been well known that scroll compressors generate gas pulsations at discharge due to inherently possessing a fixed-compression ratio. The pulsation amplitudes are especially significant under high pressure conditions as in air conditioning and refrigeration or for operating under either an under-compression or an over-compression when pressure at the discharge port is either greater or less than the pressure of the compressed gas pocket just before the opening. According to the conventional theory, an under-compression produces a rapid backflow of the gas into the pocket while an over-compression causes a rapid forward flow of the gas from the pocket. These flow pulsations are periodic in nature and very harmful if left undampened, such as inducing noises and exciting structural and system vibrations.

To lessen the problem, a pulsation dampener typically in the form of a large volume chamber, is required at the discharge side of a scroll compressor to dampen the gas borne pulsations. But its effectiveness is limited for gas pulsation control and produces other problems like inducing structural vibrations and exciting noises of other frequencies. At the same time, a more effective pulsation dampening as used today often creates more pressure losses that reduce compressor overall efficiency that suffers already at off-design conditions like an under-compression or an over-compression. So with the ever demanding energy conservation and stringent NVH regulations from the government plus growing public awareness of the comfort level in residential and office applications, there is more and more an urgent need for quieter and more efficient scroll compressors.

In addition to the commonly used serial discharge dampener, a skewed porting method using a flow equalizing strategy is disclosed in U.S. Pat. No. 5,370,512 to Fujitani et al. The idea, say for under-compression as an example, is to feed back a portion of the outlet gas through an enlarged leakage slot to the compression chamber prior to discharging to the outlet, thereby gradually increasing the gas pressure inside the gas pocket, hence reducing discharge gas pressure spikes when compared with a sudden opening at discharge. However, its effectiveness for gas pulsation attenuation is limited in practice to only 5-10 dB reduction, not enough for today's demands from both the market and the general public. Moreover, compressor efficiency suffers due to enlarged leakage area from skewed porting as reported.

It is against this background that prompts a new gas pulsation theory by the present inventor postulating that a composition of large amplitude waves and induced fluid flow under the off-design conditions (an under-compression or an over-compression) are the primary causes of high gas-borne pulsations and low efficiency. The new gas pulsation theory is based on a well studied physical phenomenon as occurs in a classical shock tube (invented in 1899 by French scientist Pierre Vieille) where a diaphragm separating a region of high-pressure gas $p_4$ from a region of low-pressure gas $p_1$ inside a closed tube. As shown in FIGS. 1A-1B, when the diaphragm is suddenly broken, a series of expansion waves is generated propagating to the high-pressure $p_4$ region at the speed of sound, and simultaneously a series of pressure waves which quickly coalesces into a shockwave is propagating to the low-pressure $p_1$ region at a speed faster than the speed of sound. Between the oppositely travelled shock wave and expansion waves, a unidirectional flow is induced in the same direction as the shockwave but travels at a slower velocity $\Delta U$. The interface separating low and high pressure gases, referred to as the contact surface, travels at the same velocity $\Delta U$ as the induced flow.

By analogy, the sudden opening of the diaphragm separating the high and low pressure gases in a shock tube is just like the sudden opening of the compressed gas pocket to discharge port under off-design conditions, because both are transient in nature and driven by the same forces from a suddenly exposed pressure difference. In this way, the well established results of the Shock Tube theory accumulated over the past 100 years can be readily applied to examine hence reveal the gas pulsation mechanism of a scroll type compressor or expander.

To understand the gas pulsation generation mechanism, a cycle of a classical scroll compressor as illustrated in FIG. 3A is examined by following one flow pocket marked dark in the illustration (in reality, two pockets are formed symmetrically as two scrolls are engaged with each other). In suction phase in FIG. 3A, low pressure gas first enters circumferentially the spaces between spirals of a pair of orbiting and stationary scrolls from the peripheral side of the scroll. Then gas becomes trapped in a crescent-shaped pocket as it is moved to the center and simultaneously being compressed as the trapped volume between the spirals decreases as shown in trapping and compression phases from FIG. 3A. The discharging phase shows the moment that the compressed gas is suddenly opened to the discharge port. A serial dampener, typically a large volume chamber located right after the discharge port, is commonly employed to attenuate pulsations generated in the gas stream as shown in the dampening phase before flows out to a downstream pipe.

According to the conventional theory when the pocket is opened to the discharge port in case of an under-compression, a backflow would rush into the pocket compressing the gas and equalizing the pressure inside the pocket with the discharge pressure. Since it is almost instantaneous and there is no volume change taking place inside the pocket, the compression is regarded as a constant volume process, or an iso-choric process that inherently consumes more work compared with an internal adiabatic compression (as indicated on P-V diagram by the additional "horn" area).

However, in light of the shock tube theory, the discharging phase as shown in FIG. 3A resembling the diaphragm bursting of a shock tube as shown in FIG. 1B would generate a composition of pressure waves (due to 3D effects and limited pocket size inside scroll compressor, these pressure waves may not be able to coalesce into a real shockwave as taking place in an one-dimensional long shock tube), expansion waves and induced flow. The pressure wave front sweeps through the low pressure gas inside the pocket and compresses it at the same time at the speed of sound as in case of the under-compression. While for the over-compression, a fan of expansion waves would sweep through the high pressure gas inside the pocket and expand it at the same time at the local speed of sound. This results in an almost instantaneous adiabatic wave compression or expansion well before the induced flow interface (backflow as in conventional theory) could arrive because wave travels much faster than the fluid, as illustrated by the wave propagation pattern in FIGS. 3C-3D. In this view, the pressure waves are the primary driver for the compression as in case of the under-compression while the backflow is simply an induced flow behind the pressure waves after compression takes place. Moreover, as the pressure waves travel to low pressure pocket as shown in FIG. 3C, a simultaneously generated expansion wave front travels in the opposite direction causing rapid pressure reduction and inducing a rapid backflow down-stream. It is believed, by the new theory, that this expansion wave front and the accompanying induced back flow are the main sources of gas pulsations experienced at discharge port for a scroll compressor during an under-compression. While for the over-compression, the gas pulsations at discharge are a composition of the pressure wave front and induced forward flow into the pipe downstream, as the simultaneously generated expansion waves travel into the high pressure pocket as shown in FIG. 3D. Any effective pulsation control should address all of these bi-directional waves and induced unidirectional flow at the same time while minimizing potential flow losses in the process.

Based on this new insight, the pre-opening to discharge as disclosed by Fujitani et al is predicted to be able to reduce gas pulsations, to a degree, by feeding back part of the gas fluid to elongate the discharging time. However, it failed to recognize hence attenuate the simultaneously generated expansion or pressure waves at the pre-opening that eventually would travel down-stream unblocked, causing high gas pulsations. Moreover, the prior art failed to address the high flow losses associated with the high induced fluid velocity through the serial dampener and discharging process, resulting in low compressor off-design efficiency.

The theory underlining the present invention can be summarized into the following Pulsation Rules for industrial applications because the large amplitude of most of the industrial gas pulsations that far exceed the upper limit of 140 dB of the classical Acoustics would invalidate the small disturbance assumption and the use of linearized wave equation. The Pulsation Rules are intended as a simplified way to answer some fundamental questions of gas pulsations such as: What is the physical nature of gas pulsations? What exactly triggers them to happen? Where and when are they generated and how to predict quantitatively their behaviors at source such as amplitude, travelling direction and speed? In principle, these rules are applicable to different gases and for gas pulsations generated by any industrial PD type gas machinery or devices such as engines, expanders, or pressure compressors, vacuum pumps, or even for pulsations generated by valves say in a pipe line.

1. Rule I: For any two divided compartments, either moving or stationery, with different gas pressures $p_1$ and $p_4$, there will be no or little gas pulsations generated if the two compartments stay divided (isolated).
2. Rule II: If, at an instant, the divider between the high pressure gas $p_4$ and the low pressure gas $p_1$ is suddenly removed in the direction of divider surface, gas pulsations are instantaneously generated at the location of the divider and at the instant of the removal a composition of a fan of Compression Waves (CW) or a quasi-shockwave, a fan of Expansion Waves (EW) and an Induced Fluid Flow (IFF) with magnitudes as follows:

$$CW=p_2-p_1=p_1[(p_4/p_1)^{1/2}-1]=(p_4\times p_1)^{1/2}-p_1 \quad (1)$$

$$EW=p_4-p_2=CW*(p_4/p_1)^{1/2}=p_4-(p_4\times p_1)^{1/2} \quad (2)$$

$$\Delta U=(p_2-p_1)/(\rho_1\times W)=CW/(\rho_1\times W) \quad (3)$$

Where $\rho_1$ is the gas density at low pressure region, W is the speed of the lead compression wave, ΔU is the velocity of Induced Fluid Flow (IFF);

3. Rule III: Pulsation component CW is the action by the high pressure ($p_4$) gas to the low pressure ($p_1$) gas while pulsation component EW is the reaction by low pressure ($p_1$) gas to high pressure ($p_4$) gas in the opposite direction, and their magnitudes are such that they approximately divide the pre-trigger pressure ratio $p_4/p_1$, that is, $p_2/p_1=p_4/p_2=(p_4/p_1)^{1/2}$. At the same time, CW and EW pair together to induce the third pulsation component, a unidirectional fluid flow IFF in a fixed relationship of CW-IFF-EW.

Rule I implies that there would be no or little pulsations during the suction, transfer and compression (expansion) phases of a scroll cycle because of the absence of either a pressure difference or a sudden opening. The focus instead should be placed upon the discharge phase, especially at the moment when the discharge port is suddenly opened and during off-design conditions like either an under-compression, UC (over-expansion, OE) or over-compression, OC (under-expansion, UE).

Rule II indicates specifically the location and the moment of pulsation generation are at the discharge and at the instant the discharge port suddenly opens. Moreover, it defines two sufficient conditions for gas pulsation generation:

a) The existence of a pressure difference $p_4-p_1$;
b) The sudden opening of the divider separating the pressure difference $p_4-p_1$.

Because a scroll compressor or an expander converts energy between shaft and fluid by dividing incoming continuous fluid stream into parcels of pocket size and then discharges each pocket separately at the end of each cycle, there always exists a "sudden" opening at discharge phase to return the discrete fluid parcels back to a continuous fluid stream again. So both sufficient conditions are satisfied at the moment of the discharge opening if scroll compressors and expanders operate at the off-design points such as UC (OE) or OC (UE).

Rule II also reveals the composition and magnitudes of gas pulsations as a combination of large amplitude Compression Waves (CW) or a quasi-shockwave, a fan of Expansion Waves (EW) and an Induced Fluid Flow (ΔU). These waves are non-linear waves with ever changing wave form during propagation. This is in direct contrast to the acoustic waves that are linear in nature and wave fronts stay the same and do not induce a mean through flow. It is also noted that the three different pulsations (CW, EW and IFF) are generated as a whole simultaneously and one cannot be produced without the others. This makes gas pulsations very difficult to control because it's not one but all three effects have to be dealt with.

Rule III shows further that the interactions between two gases of different pressures are mutual so that for every CW pulsation, there is always an equal but opposite EW pulsation in terms of pressure ratio ($p_2/p_1=p_4/p_2$). Together, they induce a unidirectional fluid flow pulsation (IFF) in the same direction as the compression waves (CW).

Accordingly, it is always desirable to provide a new design and construction of a scroll compressor that is capable of achieving significant gas pulsation and NVH reduction at source and improving compressor off-design efficiency while being kept compact in size and suitable for quiet, efficient and variable pressure ratio applications at the same time.

SUMMARY OF THE INVENTION

Accordingly, it is an object of the present invention to provide a scroll compressor with a shunt pulsation trap in parallel with the compression chamber for trapping and thus reducing gas pulsations by at least 20-30 dB.

It is a further object of the present invention to provide a scroll compressor with a shunt pulsation trap so that it is efficient at off-design conditions with a simple structure and high reliability.

It is a further object of the present invention to provide a scroll compressor with a shunt pulsation trap as part of the compressor casing so that it is compact in size without the loss and need for a serially connected dampener at discharge.

It is a further object of the present invention to provide a scroll compressor with a shunt pulsation trap that is capable of achieving reduced gas pulsations and NVH in a wide range of pressure ratios.

It is a further object of the present invention to provide a scroll compressor with a shunt pulsation trap that is capable of achieving higher gas pulsation and NVH attenuation in a wide range of speeds.

BRIEF DESCRIPTION OF THE DRAWINGS

Referring particularly to the drawings for the purpose of illustration only and not limited for its alternative uses, there is illustrated.

DETAILED DESCRIPTION OF THE PREFERRED EMBODIMENT(S)

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1A:
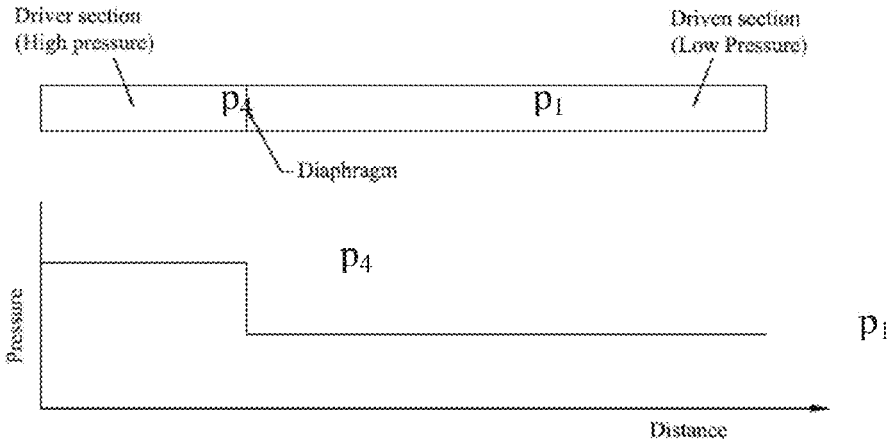
FIG. 1A shows a shock tube device with its wave diagram before the diaphragm is broken.
Figure 1B:
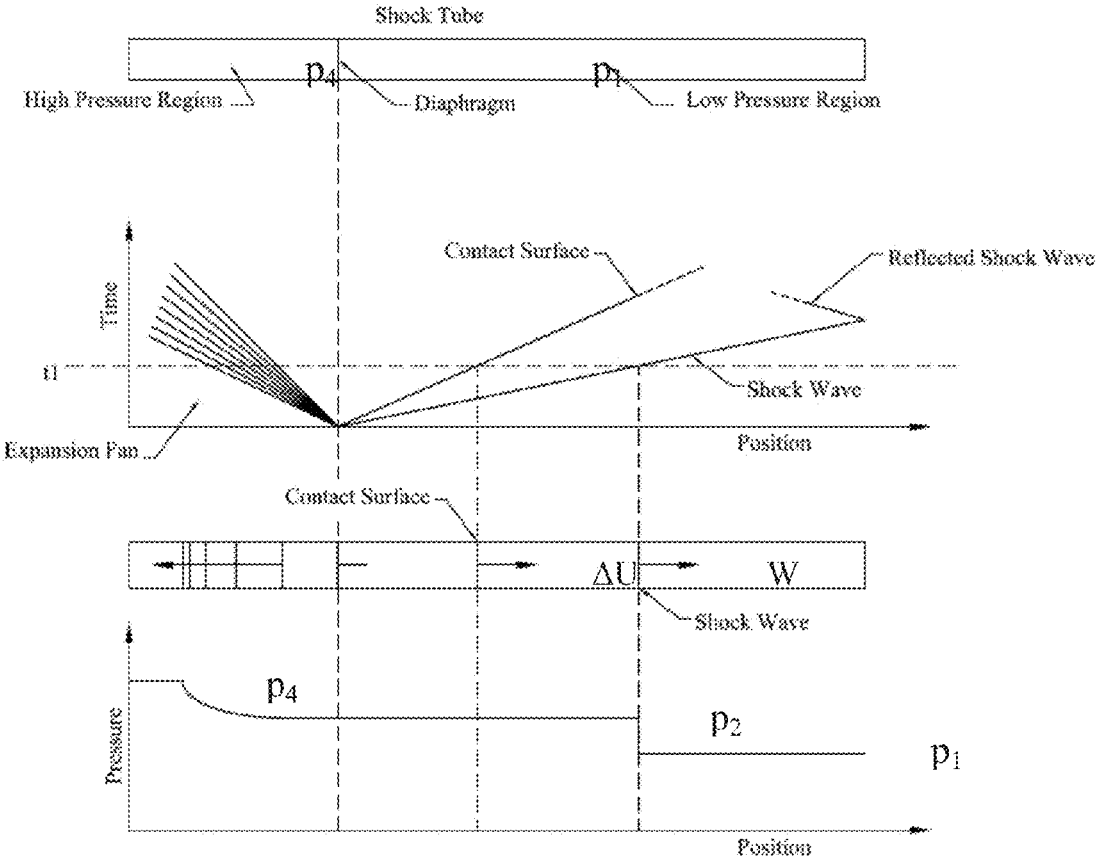
FIG. 1B shows the shock tube device of FIG. 1A with its pressure distribution diagram after the diaphragm is broken.
Figure 2A:
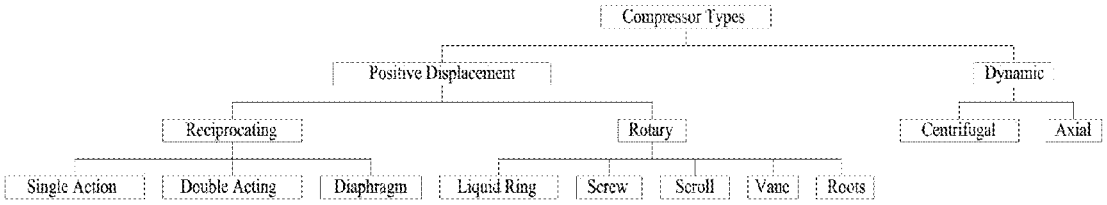
FIG. 2A shows a compressor classification chart for a sample of different types of positive displacement compressors covered under the present invention.
Figure 2B:
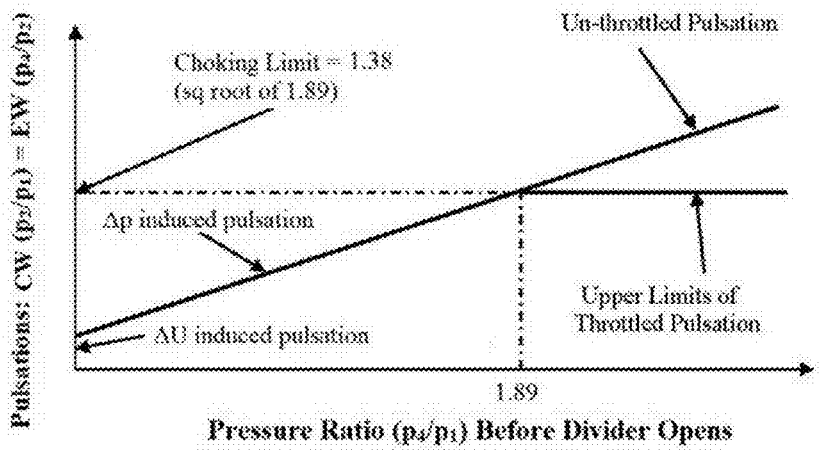
FIG. 2B shows the amplitude of gas pulsations of positive displacement compressors covered under the present invention as a function of initial pressure ratios before discharge opens.
Figure 4A:
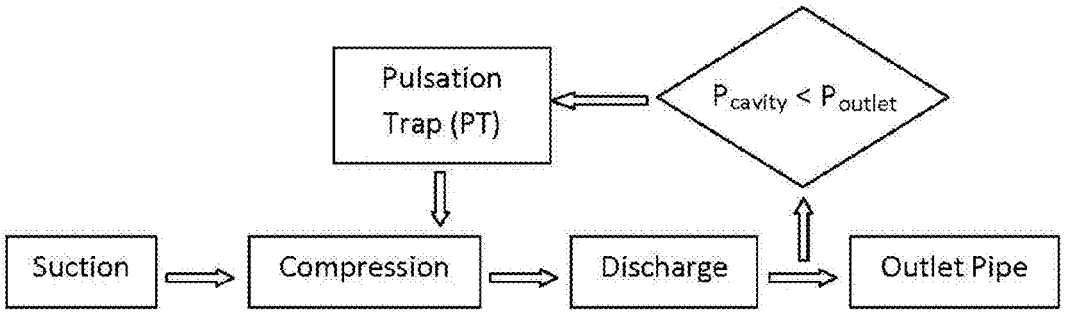
FIG. 4A shows a flow diagram of different phases of the new compression cycle of a scroll compressor with a shunt pulsation trap according to the present invention.

It should also be pointed out that though drawing illustrations and description are devoted to a scroll compressor for controlling gas pulsations from a under-compression mode in the present invention, the principle can be applied to other types of positive displacement compressors no matter it is a reciprocating or rotary as classified in FIG. 2A, because they all have the same pulsation control cycle—an essentially feedback control loop as shown in FIG. 4A. The same is true for an over-compression mode or other media such as gas-liquid two phase flow or a refrigerant as used in air-conditioning and refrigeration. In addition, scroll expanders or engines are the above variations too except being used to generate shaft power.

Figure 3A:
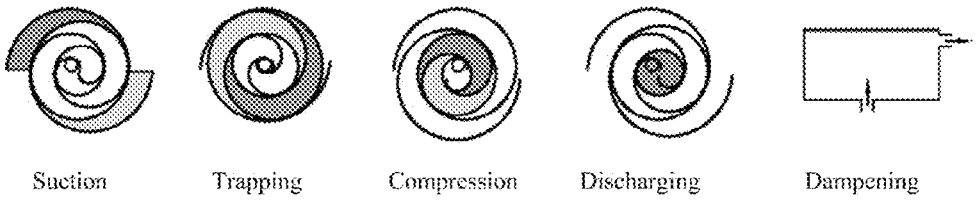
FIG. 3A (Prior Art)
FIG. 3A shows a series of views depicting the compression cycle of a conventional prior-art scroll compressor.
Figure 3B:
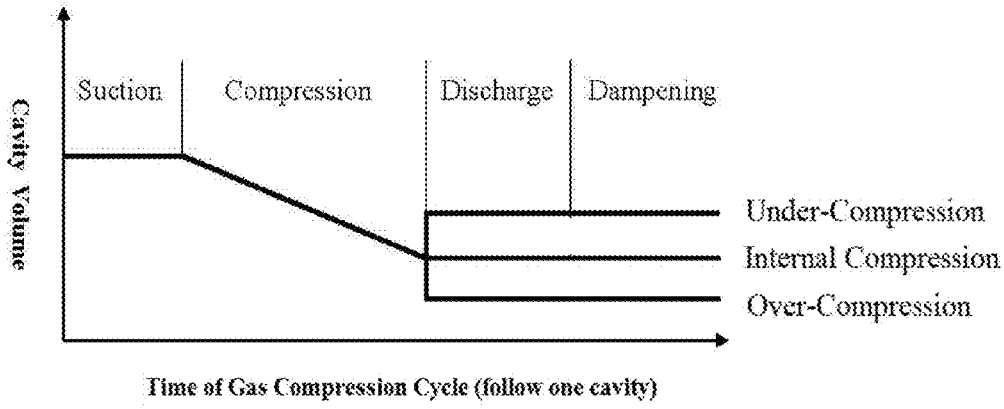
FIG. 3B (Prior Art)
FIG. 3B shows a graph plotting the compression cycle in time domain of the conventional prior-art scroll compressor of FIG. 3A.
Figure 3C:
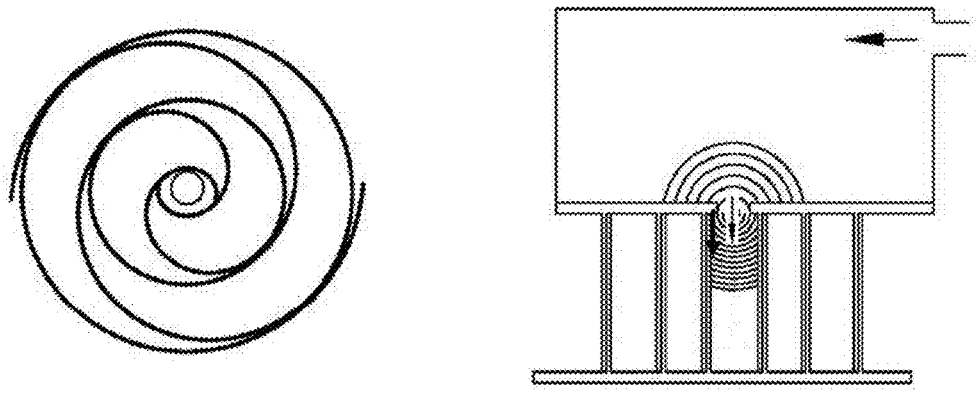
FIG. 3C (Prior Art)
FIG. 3C shows a wave diagram and a device drawing of the trigger mechanism of pulsation origination for an under-compression when discharge is suddenly opened for the compression cycle of the conventional prior-art scroll compressor of FIG. 3A.
Figure 3D:
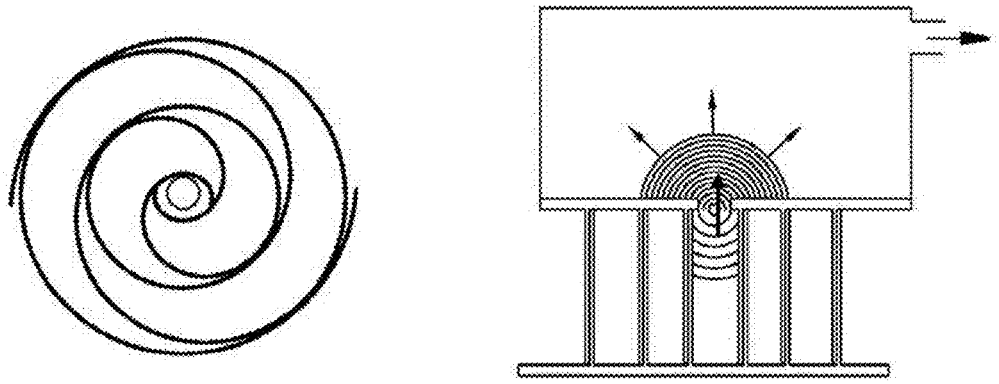
FIG. 3D (Prior Art)
FIG. 3D shows a wave diagram and a device drawing of the trigger mechanism of pulsation origination for an over-compression when discharge is suddenly opened for the compression cycle of the conventional prior-art scroll compressor of FIG. 3A.
Figure 4B:
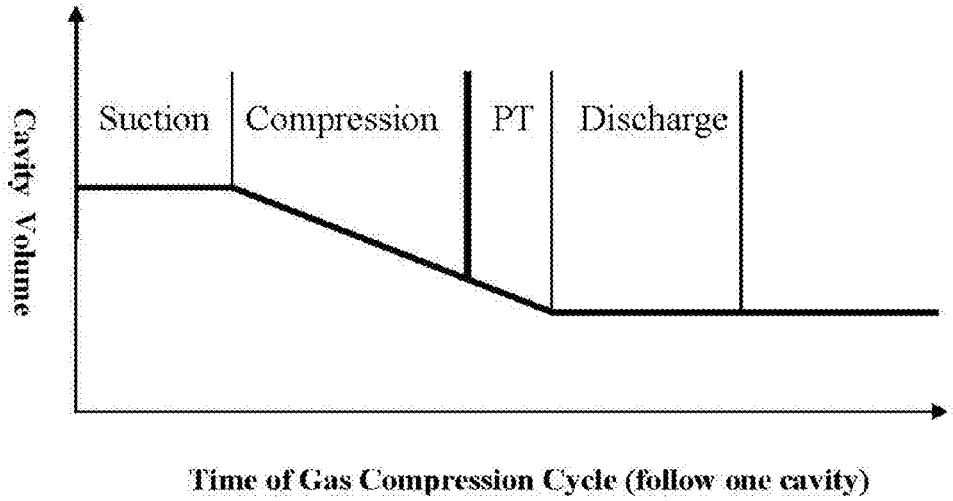
FIG. 4B shows a graph plotting the phase sequence of under-compression in time domain of the scroll compressor with shunt pulsation trap of FIG. 4A.
Figure 4C:
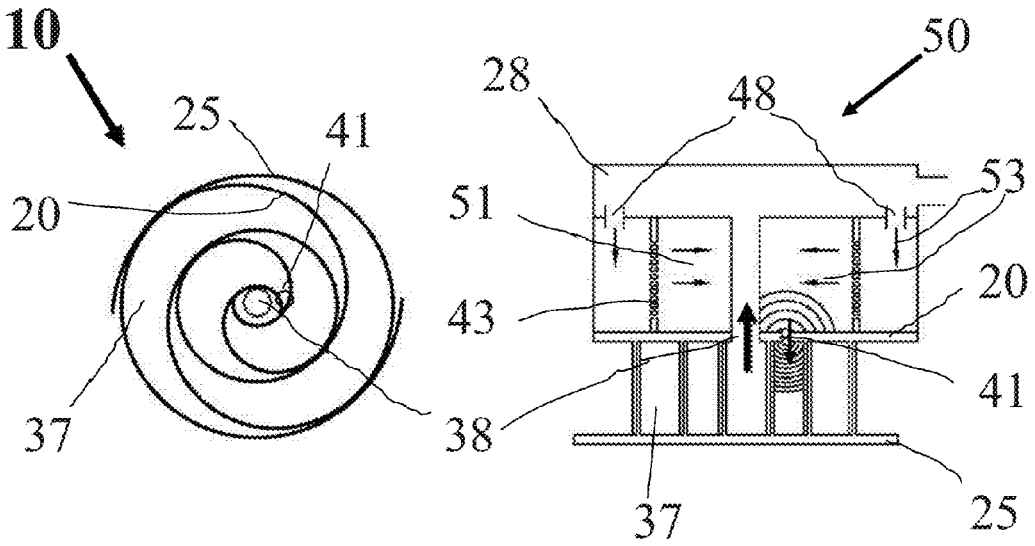
FIG. 4C shows a wave diagram and a device drawing of the trigger mechanism of pulsation origination for an under-compression when the trap inlet port is suddenly opened of the scroll compressor with shunt pulsation trap of FIG. 4A.
Figure 4D:
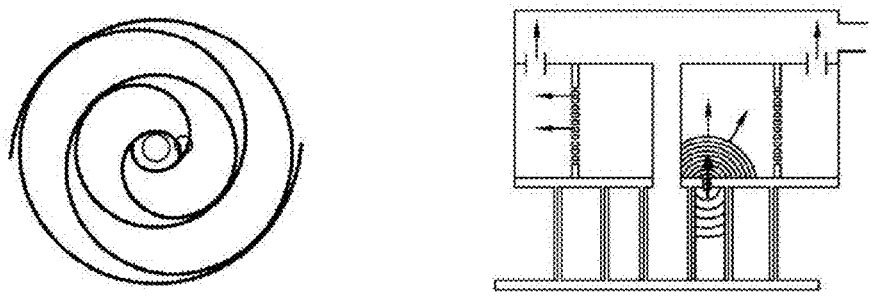
FIG. 4D shows a wave diagram and a device drawing of the trigger mechanism of pulsation origination for an over-compression when the trap inlet port is suddenly opened of the scroll compressor with shunt pulsation trap of FIG. 4A.

As a brief introduction to the principle of the present invention, FIGS. 4A to 4B show a new cycle of a scroll compression with the addition of a shunt (parallel) pulsation trap of the present invention just before the compression phase finishes, but before discharge phase starts. In broad terms, pulsation traps are used to trap AND to attenuate pulsations in order to reduce gas borne pulsations before discharging to downstream applications or releasing to atmosphere. Discharge dampener is one type of pulsation trap (conventional type) which is connected in series with and right after the compressor discharge port. The strategy is to filter out hence attenuate the low frequency "pulsations" while let go with as little loss as possible the "average flow". This is difficult to achieve in reality because the undesirable "pulsations" always co-exist with the "average flow" and trying to control one will always harm the other in the conventional serially connected dampener. The shunt pulsation trap is another type of pulsation trap which is connected in parallel with the compression pocket and located before the compressor discharge port. As illustrated in FIGS. 4A-4B, the phases of flow suction and compression are still the same as those shown in FIGS. 3A-3B of a traditional scroll cycle. But just before the compression phase finishes and discharge phase begins as in a conventional scroll compressor, a new pressure equalizing phase is added between the compression and discharge phases by subjecting the compressed flow pocket to a pre-opening port, called pulsation trap inlet port, located just before the compressor discharge port and timed before the compression phase finishes as shown in FIG. 4A-4D. While the earliest possible position for trap inlet port to pre-open into the compression pocket is only after the compression pocket has been shut off from the suction port or becomes trapped. Structurally, the trap inlet port is branched off from the compression pocket or compression chamber into a parallel chamber, called pulsation trap chamber, which is also communicating with the compressor discharge pressure through a feedback port called trap outlet port adjacent to compressor discharge chamber, as shown in FIGS. 4C-4D. Between the trap inlet and outlet ports, and within the trap chamber, there exists one or more of various pulsation dampening devices, to control (i.e., to provide pulsation dampening and/or pulsation containment functionality) pulsation energy before it travels to the compressor discharge port. As shown in top illustration of FIG. 4C at the moment when the compression pocket is just opened to the trap inlet port while still closed to the compressor discharge port, a composition of waves and flows are produced at trap inlet port if there is a pressure difference between the pulsation trap (relates to compressor outlet pressure) and compression pocket. For an under-compression, pressure waves or quasi-shockwave are generated into the low pressure pocket increasing its pressure and inducing a back flow into the pocket at the same time, while on the other side, a simultaneously generated expansion waves travel into the high pressure trap and are being attenuated. Because waves travel at a speed about 5-20 times faster than the scroll speed, the pressure equalization inside the pocket or pulsation attenuation inside the trap chamber are almost instantaneous, and finishes before the compression pocket reaches the discharge port. Therefore, as shown in the bottom illustration of FIG. 4*c* at the moment when the compression pocket is opened to the compressor discharge port, the pressure inside the pocket is already equal to the outlet pressure, hence discharging a pressure-difference-free, or a pulsation-free gas flow. The same principle applies to an over-compression condition but with reversed wave patterns and induced flow as shown in FIG. 4D.

The principal difference with the conventional scroll compressor is in the discharge and dampening phase: instead of waiting and delaying the dampening phase after the discharge by using a serially-connected dampener, the present invention shunt pulsation trap method would start dampening before the discharge by inducing pulsations into a paralleled trap. It then dampens the pulsations within the trap and compression pocket simultaneously as the compression chamber travels to the discharge port. In this process, the average main flow inside the compression pocket and pulsations are separated and in parallel with each other so that attenuating the undesirable pulsations will not affect the efficiency of the main average flow.

There are several advantages associated with the parallel pulsation trap compared with a conventional serially connected dampener. First of all, pulsations are separated out from the main pocket flow so that an effective attenuation on pulsations will not affect the losses of the main pocket flow, resulting in both higher main flow efficiency and better pulsation attenuation effectiveness. In a conventional serially connected dampener, both pulsations and main fluid flow travel mixed together through the dampening elements where a better attenuation on pulsations always comes at a cost of higher flow losses or larger damper size. So a compromise is often made in order to reduce flow losses by sacrificing the degree of pulsation dampening or having to use a very large volume dampener in a serial setup, increasing its size, weight and cost.

Secondly, by pre-opening to discharge pressure, the compression mode inside the compression pocket is changed from internal volume ratio controlled compression to under compression (UC), or pressure wave compression mode according to the Shock Tube theory. The UC has a unique "feedback control" capability, that is, it is a self-correcting, negative feedback control loop adaptable to different system back pressures without a variable geometry control. So an under-compression is always a preferred mode over an over-compression since the discharge system pressure will compensate whatever the additional pressure is required without wasting any energy from compressor driver. Since most scroll compressors can operate with a combined internal compression and UC modes, a design scheme can be used so that the compressor will work either under internal compression or UC, but never under over-compression (OC) in order to maximize average system efficiency and minimize pulsations and noises over a wide range of system pressures. As shown in FIG. 4B, the degree of pre-opening depends on how wide range of the off-design so that an overall optimum efficiency is achieved.

Thirdly, the parallel pulsation trap attenuates pulsation much closer to the pulsation source than a serial one and is capable of using a more effective pulsation dampening device (say a much higher dampening coefficient material) without penalizing main flow efficiency. It can be built as an integral part of the stator casing as close as possible to the compression chamber so that the overall size and footprint of the compressor package is kept small. By replacing the conventional serially connected dampener with a more compact and effective parallel pulsation trap, the noise radiation and vibrating surfaces are much reduced too. Moreover, the pulsation trap casings can be made of a metal casting that will be more wave or noise absorptive, thicker and more rigid than a conventional sheet-metal dampener casing, thus further reduce noise and vibration.

Referring to FIG. 4C-4D, there is shown a typical arrangement of a preferred embodiment of a scroll compressor 10 with a shunt pulsation trap apparatus 50. Typically, a scroll compressor 10 has a peripheral suction port (not shown) and a pair of orbiting and stationary scrolls 25, 20 for forming at least one compression pocket or chamber 37 that compresses the trapped gas and discharge it to a discharge port 38 near the center of the compressor 10. Between the scroll compressor stationary scroll 20 and the compressor discharge chamber 28, the pulsation trap chamber 51 is formed.

As an important novel and unique feature of the present invention, a shunt pulsation trap apparatus 50 is positioned parallel with the compression pocket 37 of the scroll compressor 10 of the present invention, and its generic cross-section is illustrated in FIG. 4C. In the embodiment illustrated, the shunt pulsation trap apparatus 50 is further comprised of a trap inlet port 41 branching off from the compression pocket 37 into the pulsation trap chamber 51 and a trap outlet port 48 connecting pulsation trap chamber 51 with compressor discharge chamber 28, therein housed various pulsation dampening device 43. As trap inlet port 41 is suddenly opened as shown in FIG. 4C, a series of pressure waves are generated at trap inlet port 41 going into the compression pocket 37 and a feedback flow 53 is induced at the same time. Simultaneously a series of expansion waves are generated at trap inlet port 41, but travelling in a direction opposite to the feedback flow from trap inlet port 41 going through dampener device 43 before reaching trap outlet port 48 and compressor discharge chamber 28. The feedback flow 53 as indicated by the small arrows goes from the trap outlet port 48 through the dampener 43 into the pulsation trap chamber 51 then converging to the trap inlet port 41 and releasing into the compression pocket 37. To improve the flow efficiency of the induced feedback flow 53 at the trap inlet port 41, instead of a constant area orifice 61, an alternative converging cross-sectional shape 63 or a converging-diverging cross-sectional (De Laval nozzle) shape 65 as shown in FIG. 6B can be used in the feedback flow direction 53. In FIG. 4C, the large arrow shows the direction of the main flow inside the pocket 37 when discharged to compressor discharge port 38.

When a scroll compressor 10 is equipped with the shunt pulsation trap apparatus 50 of the present invention, there exist both a significant reduction in the pulsation transmitted from scroll compressor to compressor downstream as well as an improvement in internal flow field (hence its adiabatic efficiency) for an under-compression case.

The theory of the operation underlying the shunt pulsation trap apparatus 50 of the present invention is as follows. As illustrated in FIG. 4A-4D and also refer to FIG. 5A-5B, phases of flow suction, trapping and compression are still the same as those shown in FIGS. 3A-3B of a conventional scroll compressor. But just before compression phase finishes, instead of being opened to compressor discharge port 38 as the conventional scroll compressor does, the compressed flow pocket 37 is pre-opened to the trap inlet port 41 while the discharge port 38 is still closed. As shown in FIG. 4C, if there is no pressure difference between pulsation trap chamber 51 (close to pressure at discharge chamber 38) and compression pocket 37, then no pulsations are generated even as they are connected. But if a pressure difference exists, a series of pressure waves or a quasi-shock wave are generated into the pocket for the under-compression (or a series of expansion waves are generated into the pocket for the over-compression). The pressure waves traveling into compression pocket 37 compress the trapped gas inside and at the same time, the accompanying expansion waves enter the pulsation trap chamber 51, and therein are being stopped and attenuated by dampening device 43. To improve pulsation absorbing rate, acoustical absorption materials or other similar types for turning pulsation into heat, can be used either inside pulsation trap chamber 51 or lining its interior walls (not shown). Because waves travel at a speed about 5-20 times faster than scroll speed, the compression and attenuation are almost instantaneously equalizing the pressure difference, hence discharging a pulsation-free gas media to compressor discharge port 38. Therefore, the conventional serially connected outlet pulsation dampener is not needed or reduced in size thus saving space and weight.

Figure 5A:
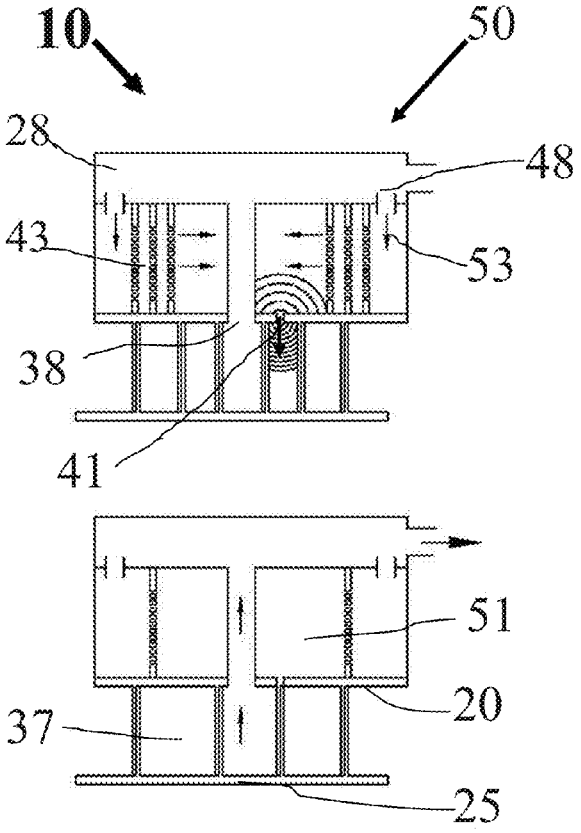
FIG. 5A shows two cross-sectional side views of a preferred embodiment of the shunt pulsation trap of FIG. 4A, each view depicting a different type/arrangement of absorptive dampening elements.

FIG. 5A shows a shunt pulsation trap 50 with at least one layer of perforated device 43 either in form of plate or tube or tubes (not shown) as dampening device(s) by possessing more closed blocking area than open hole area on the device. While pulsations are trapped by perforated device 43 inside the pulsation trap chamber 51 where it is being dampened, feedback flow 53 is still allowed to go through the pulsation trap chamber 51 unidirectionally from trap outlet port 48 to trap inlet port 41 through the perforated device 43 at high velocity. To reduce the feedback flow loss that is high for constant area shaped orifice holes 61 of a perforated device, an alternative flow nozzle 63 or de Laval nozzle 65 can be used, as shown in FIG. 6B, thus improving feedback flow efficiency compared to a conventional scroll device at under-compression conditions.

Figure 5B:
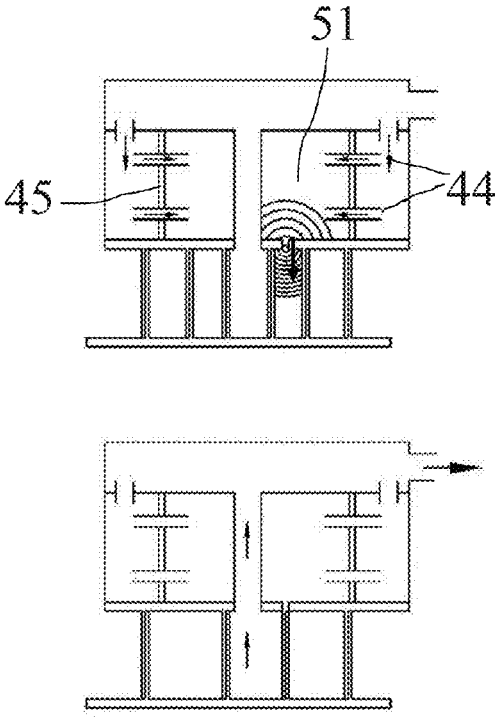
FIG. 5B shows two cross-sectional side views of a preferred embodiment of the shunt pulsation trap of FIG. 4A, each view depicting a different type/arrangement of reactive dampening elements.

FIG. 5B demonstrates another shunt pulsation trap with some typical reactive elements consisting of a composition of chokes 44 and divider plate 45 inside trap chamber 51 as dampening method. In theory, either one or more such dividers or at least one or more chokes can be used as a multistage or multi-channel dampening.

Figure 6A:
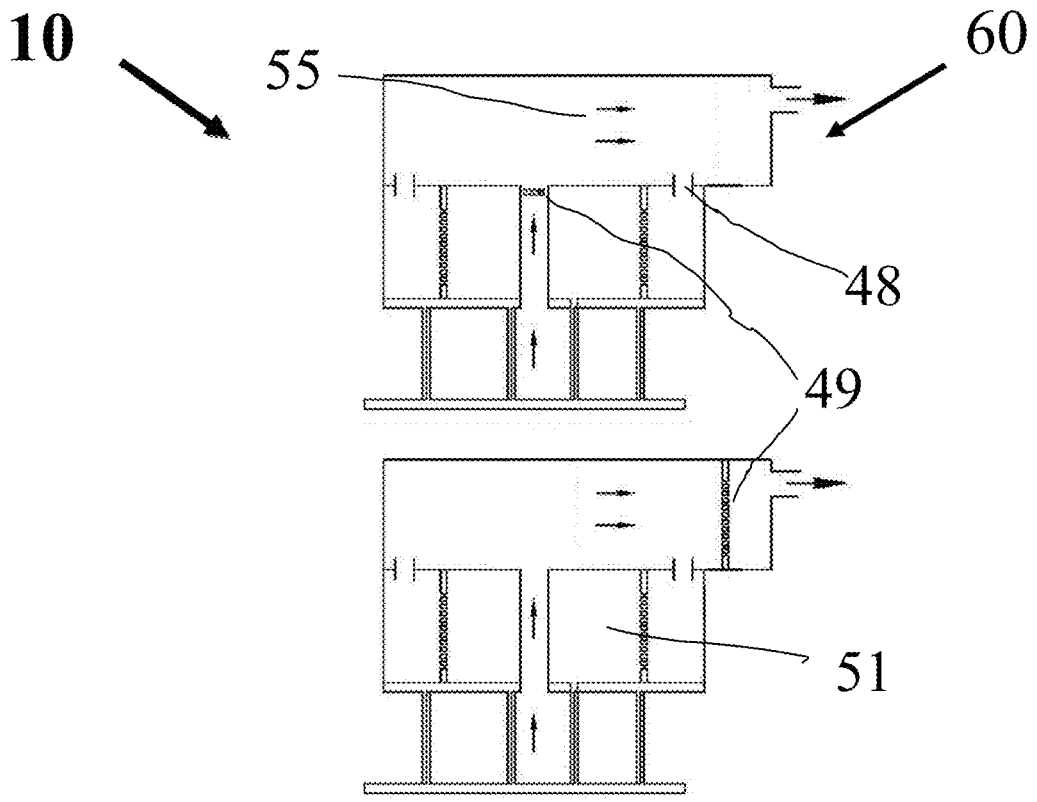
FIG. 6A shows two cross-sectional side views of an alternative embodiment of the shunt pulsation trap, each view depicting an additional and different type/arrangement of wave reflector either before (top figure) or after (bottom figure) the trap outlet.
Figure 6B:
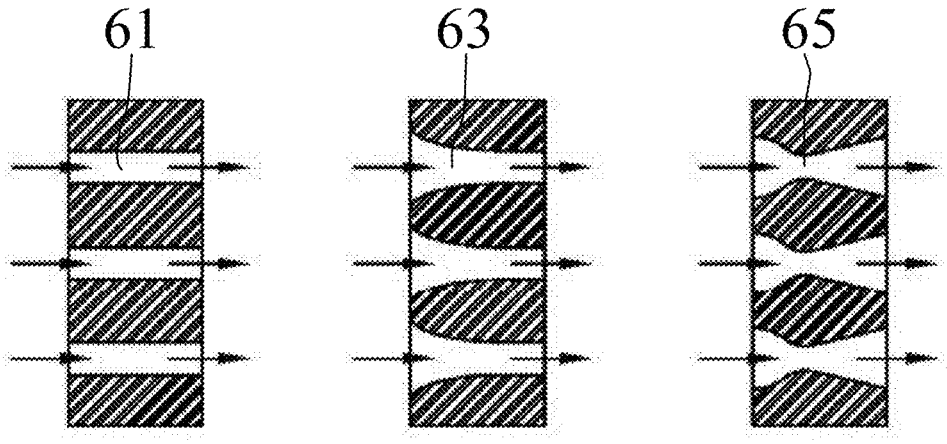
FIG. 6B shows three cross-sectional side views of three different hole shapes of a perforated device of the shunt pulsation trap.

FIG. 6A shows a typical arrangement of an alternative embodiment of the scroll device 10 with a shunt pulsation trap apparatus 60. In this embodiment, a perforated device 49 acting as both a wave reflector and a dampener is added to the preferred embodiment 50 as an additional device of the pulsation trap 60. The wave reflector 49 can be located either before or after the trap outlet port 48. In theory, a wave reflector is a device that would reflect waves while let fluid go through without too much losses. In this embodiment, the leftover residual pulsations either from the compression pocket 37 or coming out of pulsation trap outlet port 48 or both could be further contained and prevented from traveling downstream causing vibrations and noises, thus capable of achieving more reductions in pulsation and noise but with additional cost of the perforated device and some associated losses. If the reflector 49 is positioned between trap outlet port 48 and compressor discharge port 38, the feedback flow will go through the pulsation trap 51 while the main discharge flow 55 is unidirectionally going through the discharge wave reflector 49 as shown in FIG. 6A without flow reversing losses, and the associated losses are greatly reduced by using perforated holes with shape of either a flow nozzle 63 or de Laval nozzle 65 as shown in FIG. 6B, thus improving flow efficiency at discharge compared to a conventional scroll device.

Figure 7A:
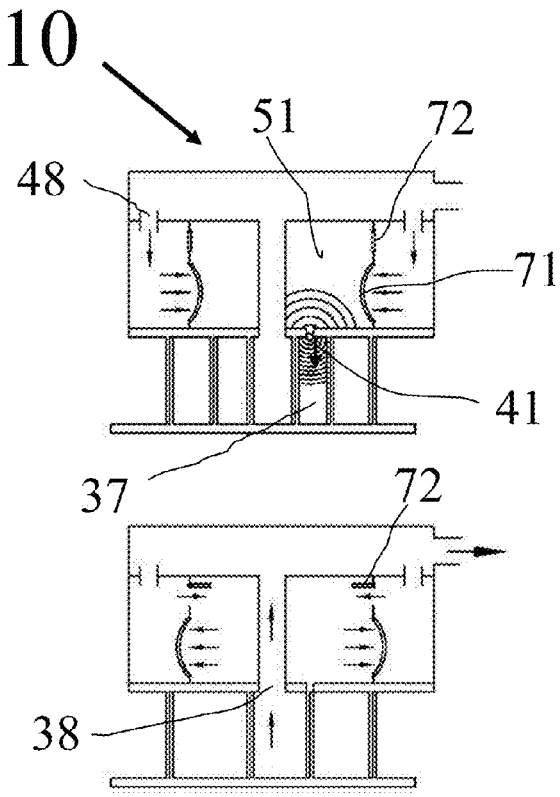
FIG. 7A shows two cross-sectional side views of another alternative embodiment of the shunt pulsation trap with a diaphragm as a dampener (top figure) and pump (bottom figure)
Figure 7B:
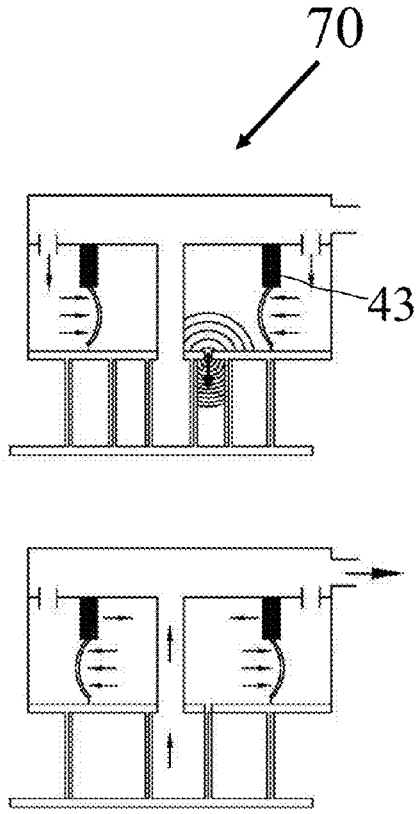
FIG. 7B shows two cross-sectional side views of another alternative embodiment of the shunt pulsation trap with a different diaphragm as a dampener (top figure) and pump (bottom figure)
Figure 9A:
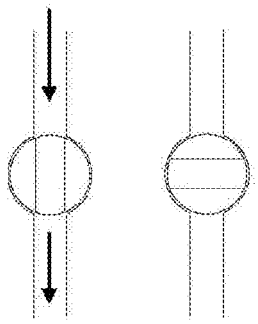
FIG. 9A shows a cross-sectional view of a rotary valve in open and close positions.
Figure 9B:
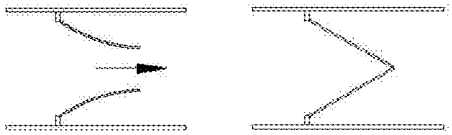
FIG. 9B shows a cross-sectional view of a reed valve in open and close positions.

FIG. 7A-7B show some typical arrangements of yet another alternative embodiment of the scroll compressor 10 with a shunt pulsation trap apparatus 70. In this embodiment, a diaphragm 71 is used as an alternative pulsation dampening device for pulsation trap 70 for providing pulsation dampening and pulsation energy recovery functionality. FIG. 7A shows a one-valve configuration and FIG. 7B a no-valve configuration with a dampener in place of the valve. In FIG. 7A, the top view shows a charging (dampening) phase with the trap inlet port 41 open to the compression pocket 37 while the trap outlet port 48 and valve 72 are closed. In the same way, the bottom view shows a discharging (pumping) phase with the trap inlet port 41 almost closed to the compression pocket 37 while the trap outlet port 48 and valve 72 open. The valve 72 used could be any types that are capable of being controlled and timed to function as described above, and one example is given in FIG. 9A-9B for a rotary valve and a reed valve. In operation, as an example shown in FIG. 7A again for under-compression, a series of waves are generated as soon as the pulsation trap inlet port 41 is open to pocket 37 during charging phase. The pressure waves would travel into the compression pocket 37 while the accompanying expansion waves enter the pulsation trap chamber 51 in opposite direction. Because of the pressure difference between the pulsation trap chamber 51 (close to pressure in discharge chamber) and compression pocket 37, the diaphragm 71 would be pulled towards the trap inlet port 41 by the pressure difference hence absorbing the pulsation energy and storing it with the deformed diaphragm 71 (charged). At this time, the valve 72 is closed, effectively isolating the waves within the pulsation trap chamber 51. As the pressure difference is diminishing and pocket 37 is opened to the discharge port 38 as shown in the bottom view of FIG. 7*a*, the diaphragm 71 would be pulled away from the trap inlet port 41 by the stored energy, resulting in a pumping action sucking gas in from the now opened valve 72, building up pressure again in the pulsation trap chamber 51. By alternatively open and close valve 72 in a synchronized way, the pulsation energy could be effectively absorbed and re-used to keep the cycle going while pulsations within the trap is kept contained and attenuated, resulting in a pulse-free discharge flow with minimal energy losses.

Figure 8:
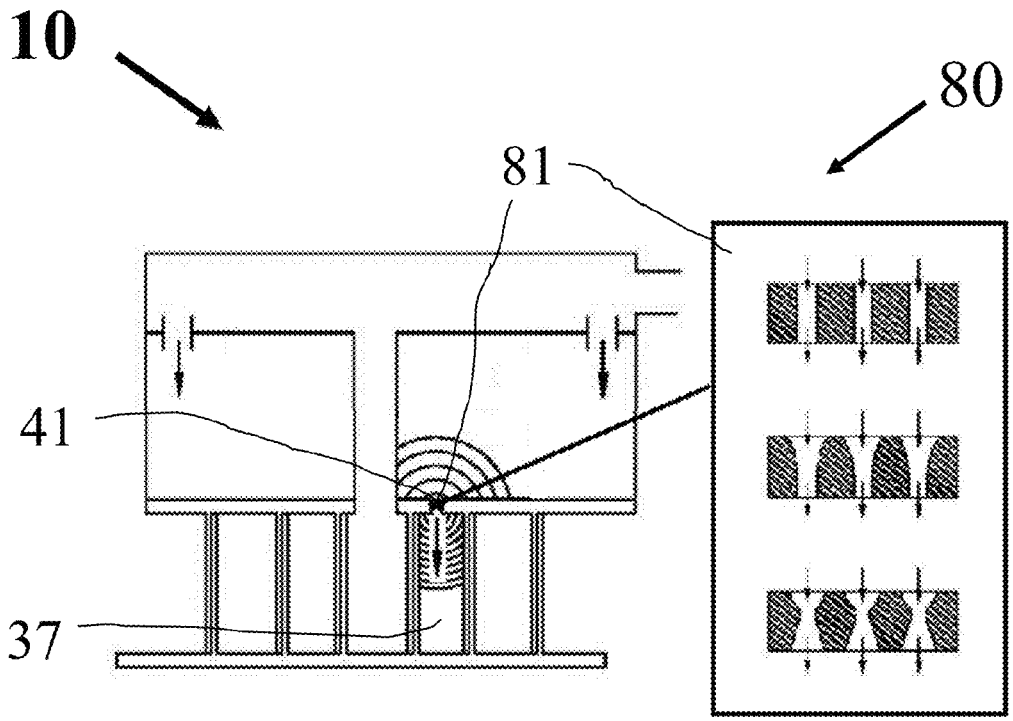
FIG. 8 shows a cross-sectional side view and an exploded detail view of an alternative preferred embodiment of the shunt pulsation trap with a plug dampener at trap inlet port.

FIG. 8 shows a typical arrangement of yet another alternative embodiment of the scroll compressor 10 with a shunt pulsation trap apparatus 80. In this embodiment, a plug dampener 81 (perforated device or acoustical absorption materials or other similar types for turning pulsation into heat) is used as an alternative pulsation eliminating device right at the trap inlet port. In theory, three types of pulsations are generated when gases at different pressures are suddenly exposed to each other with CW and IFF going into low pressure gas while EW going into high pressure gas. The plug dampener 81 can reduce the pulsation strength for all three types of pulsations right at the source when they are generated: the trap inlet port 41. Either perforated device or other devices with acoustical absorption functions can be used. The shape of the perforated holes could be of an orifice 61, a flow nozzle 63 or de Laval nozzle 65.

Figure 10:
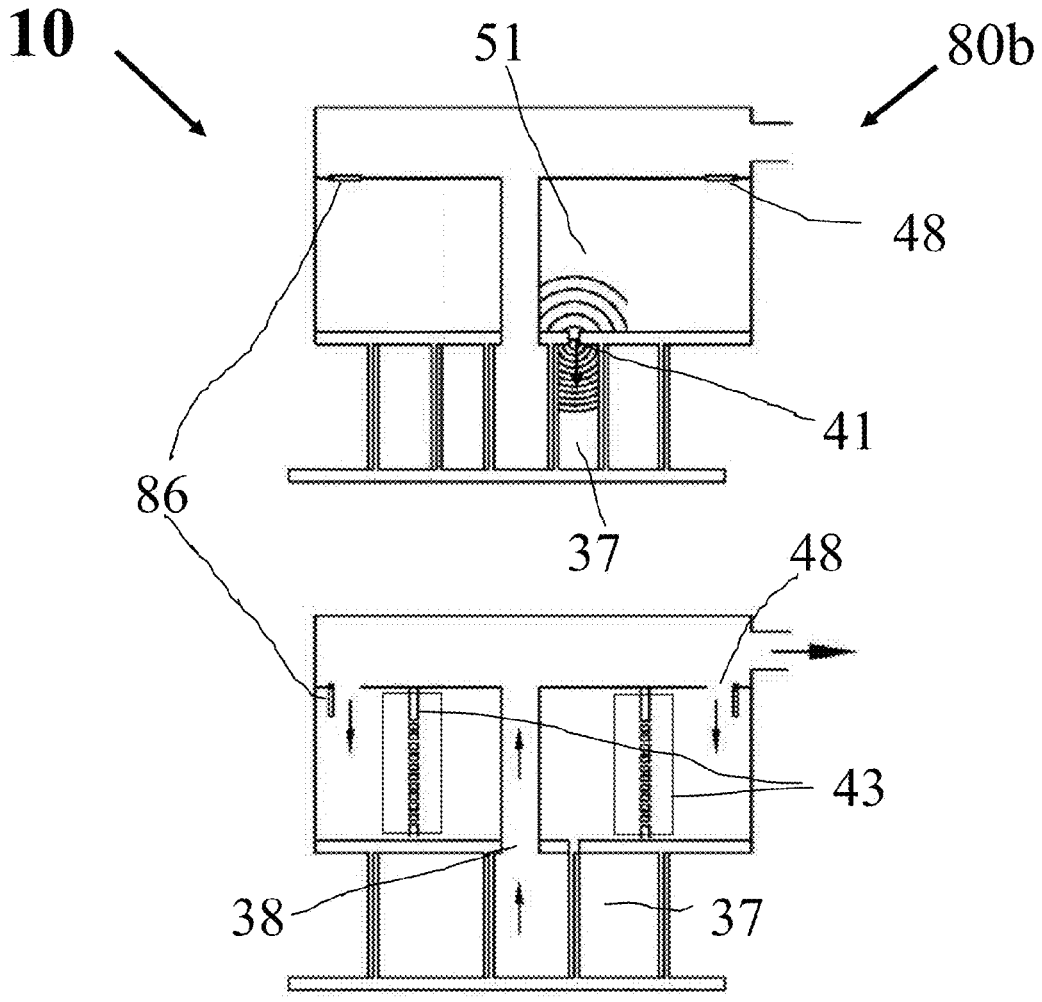
FIG. 10 shows two cross-sectional side views of yet another alternative embodiment of the shunt pulsation trap, each view depicting a different valve at trap outlet port.

FIG. 10 shows a typical arrangement of yet another alternative embodiment of the scroll compressor 10 with a shunt pulsation trap apparatus 80*b*. In this embodiment, a control valve 86 is used as pulsation dampening device for pulsation trap 80*b* at trap outlet port 48 for providing pulsation dampening and pulsation containment functionality. In addition, FIG. 10 shows a configuration with an optional dampening device 43 between trap inlet port 41 and control valve 86. The principle of operation is to take advantage of the opposite travelling direction of expansion waves and induced flow inside the pulsation trap 80*b* during an under-compression. By using a directional controlled valve 86, it would only allow flow in while keeping the waves from going out of the trap in a timed fashion. The top view of FIG. 10 shows the wave containment phase with the trap inlet port 41 open to the compression pocket 37 while the trap outlet port 48 is closed by the valve 86. In the same way, the bottom view of FIG. 10 shows a flow-in phase when the compression is finished and the trap outlet port 48 is opened through the valve 86. The valve 86 used could be any types that are capable of being flow controlled like a reed valve or timed with trap inlet opening in a fashion as described above, and one example is given in FIG. 9A for a rotary valve. In operation, as an example shown in FIG. 10 again for under-compression, a series of waves are generated as soon as the pulsation trap inlet port 41 is opened during the containment phase. The pressure waves would travel into the pocket 37 while the accompanying expansion waves enter the pulsation trap chamber 51 in opposite direction. At this time, the valve 86 located at the trap outlet port 48 is closed, effectively isolating the pulsations within the pulsation trap chamber 51 where it could be dampened by an optional dampening device 43 inside. After the pressure difference is diminishing and pocket 37 is opened to discharge port 38 as shown in the bottom view of FIG. 10, the valve 86 at trap outlet port 48 is opened allowing gas into the trap and building up the pressure again in the pulsation trap chamber 51. By alternatively open and close the valve 86 in a synchronized way timed with the trap inlet opening, the waves and pulsation energy could be effectively contained within the trap, resulting in a pulse-free gas flow to the outlet.

It is apparent that there has been provided in accordance with the present invention a scroll compressor with a shunt pulsation trap for effectively reducing the gas pulsations caused by under-compression or over-compression without increasing the overall size or sacrificing the efficiency of the compressor. While the present invention has been described in context of the specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A scroll compressor, comprising:

a. a pair of scrolls forming at least one compression chamber with a peripheral suction port and a center discharge port, wherein an orbiting one of the pair of scrolls rotates relative to a stationary one of the pair of scrolls to move gas pockets in a flow direction from the peripheral suction port towards the center discharge port; and b. a compressor discharge chamber in series with and following the center discharge port; and c. a shunt pulsation trap apparatus comprising a pulsation trap chamber adjacent to said compression chamber, at least one pulsation dampener positioned within the pulsation trap chamber, at least one trap inlet branching off from said compression chamber before said discharge port in said flow direction and connecting said compression chamber to said pulsation trap chamber so that at least a portion of said compression chamber and said pulsation trap chamber are arranged in parallel, and at least one trap outlet connecting said pulsation trap chamber to said compressor discharge port, wherein said scroll compressor achieves gas pulsation and NVH reduction at said pulsation trap chamber and improving compressor off-design efficiency.

2. The scroll compressor as claimed in claim 1, wherein said trap inlet is positioned at least being sealed from said suction port connected through said compression chamber but always before said discharge port.

3. The scroll compressor as claimed in claim 2, wherein said trap inlet has a converging cross-sectional shape or a converging-diverging cross-sectional De Laval nozzle shape in a feedback flow direction.

4. The scroll compressor as claimed in claim 1, wherein said pulsation dampener comprises at least one layer of perforated device.

5. The scroll compressor as claimed in claim 1, wherein said pulsation dampener comprises at least one divider plate with chokes inside said pulsation trap chamber.

6. The scroll compressor as claimed in claim 1, wherein said pulsation dampener comprises at least one layer of perforated device and at least one synchronized valve that is positioned thereon and that is closed or opened as said pulsation trap inlet is opened or closed respectively to said compression chamber.

7. The scroll compressor as claimed in claim 1, wherein said pulsation dampener comprises at least one plug dampener at said pulsation trap inlet.

8. The scroll compressor as claimed in claim 1, wherein said pulsation dampener comprises at least one plug dampener at said pulsation trap inlet in series with at least one layer of perforated device inside said pulsation trap chamber.

9. The scroll compressor as claimed in claim 1, wherein said pulsation dampener comprises at least one plug dampener at said pulsation trap inlet in series with at least one synchronized valve that is closed or opened as said pulsation trap inlet is opened or closed to said compression chamber.

10. The scroll compressor as claimed in claim 1, wherein said pulsation dampener comprises at least one diaphragm in parallel with at least one layer of perforated device for partially absorbing pulsation energy and turning that energy into pumping gas from said trap outlet through said perforated device into said trap inlet.

11. The scroll compressor as claimed in claim 1, wherein said pulsation dampener comprises at least one diaphragm or piston in parallel with an opening for absorbing pulsation energy and turning that energy into pumping gas from said trap outlet through said opening into said trap inlet.

12. The scroll compressor as claimed in claim 1, wherein said pulsation dampener comprises at least one diaphragm or piston synchronized with at least one valve for absorbing pulsation energy and turning that energy into pumping gas from said trap outlet through said valve into said trap inlet.

13. The scroll compressor as claimed in claim 1, wherein said shunt pulsation trap apparatus further comprises at least one perforated device located at said discharge port but before said trap outlet.

14. The scroll compressor as claimed in claim 1, wherein said pulsation dampener comprises at least one control valve located at said trap outlet.

15. The scroll compressor as claimed in claim 1, wherein said pulsation dampener comprises at least one layer of perforated device or acoustical absorption materials for turning pulsation into heat, in series with at least one control valve located at said trap outlet, for pulsation energy containment.

16. The scroll compressor as claimed in claims 6, 9, 14 or 15, wherein said valve is a reed valve, another one way valve, or a rotary valve that is timed to close or open as said pulsation trap inlet is opened or closed to said compression chamber.

17. The scroll compressor as claimed in claims 4, 6, 8 or 10, wherein the perforated device has holes with a cross-sectional shape of a converging shape or a converging-diverging De Laval nozzle shape in a feedback flow direction.

18. The scroll compressor as claimed in claims 7, 8 or 9, wherein the plug dampener has holes with a cross-sectional shape of a converging shape or a converging-diverging De Laval nozzle shape in a feedback flow direction.

19. The scroll compressor as claimed in claim 13, wherein the perforated device has holes with a cross-sectional shape of constant area or a converging shape or a converging-diverging De Laval nozzle shape in a feedback flow direction.

20. The scroll compressor as claimed in claim 1, wherein said pulsation dampener comprises at least one layer of acoustical absorption material for turning pulsation into heat, either inside said pulsation trap chamber or lining interior walls thereof.

* * * * *